United States Patent [19]

Hamacher

[11] 4,018,500

[45] Apr. 19, 1977

[54] JUNCTION PIECE FOR ELECTRICAL LEADS

[76] Inventor: Martin Hamacher, Nimrodstr. 47, 4352 Herten, Germany

[22] Filed: July 3, 1975

[21] Appl. No.: 593,026

[30] Foreign Application Priority Data

Mar. 27, 1975 Germany ..... 2513829

[52] U.S. Cl. ..... 339/103 R

[51] Int. Cl.[2] ..... H01R 13/58

[58] Field of Search ..... 339/103 R, 103 B, 103 L, 339/103 M, 11, 126, 132, 133, 119; 174/65 R, 65 SS, 76, 77 R; 248/56

[56] References Cited

UNITED STATES PATENTS

| | | | |
|---|---|---|---|
| 2,171,331 | 8/1939 | Folsom, Jr. | 339/103 R |
| 2,277,468 | 3/1942 | Welch | 339/119 L |
| 3,772,453 | 11/1973 | O'Brien | 174/65 SS |

*Primary Examiner*—Joseph H. McGlynn
*Attorney, Agent, or Firm*—Allegretti, Newitt, Witcoff & McAndrews

[57] ABSTRACT

Junction piece for electrical leads with a funnel-shaped entry for reception of the cable containing the electrical leads, for appliances to be supplied with current, especially extension lights, characterized in that in the region of the insertion end of the junction piece into the appliance to be supplied, an annular groove is provided for the reception of a packing ring, that a bevelled shoulder is formed on the outer wall for the full attachment on the inner wall of a socket of the appliance, that a recess in which can be engaged a yoke with shanks which recess aligns with corresponding openings in the socket, is formed in the cylindrical outer region of the junction piece and that the yoke is lockable in an attachment.

3 Claims, 4 Drawing Figures

JUNCTION PIECE FOR ELECTRICAL LEADS

BACKGROUND OF THE INVENTION

There is already on the market a junction piece for electrical leads, which is in two parts, wherein after introduction of the cable the junction piece is screwed into the socket of an appliance to be supplied with current. The essential disadvantage of this known junction device lies in that apart from the two-part construction, first of all a packing ring must be shaped fittingly for the socket and two further rings are required for holding this packing ring. The insertion and removal of this junction piece takes place through rotation. A further disadvantage lies in that through the screwing together of this two-part connector the contained cable is compressed.

SUMMARY OF THE INVENTION

The problem underlying the invention consists in the creation of a junction piece of the initially outlined kind, which is technically inexpensive, can be readily installed and ensures a rotation-resistant and pressure-safe connection of the cable/leads with the casing to be supplied with current.

This problem is solved in accordance with the invention in that in the region of the insertion end of the junction piece into the appliance to be supplied there is provided an annular groove for the reception of a packing ring, that a bevelled shoulder is formed on the outer wall for the full attachment on the inner wall of a socket of the appliance, that a recess in which can be engaged a yoke with shanks, which recess aligns with corresponding openings in the socket is formed in the cylindrical external region of the junction piece and that the yoke is lockable in an attachment.

Preferably the junction piece is so formed that it is provided with at least one longitudinal groove in the inner surface.

Advantageously the yoke has a projection, with a bore, running at right angles to its shanks, through which a screw can be screwed into the threaded bore of the attachment.

The junction piece can consist of a metal, synthetic material or other suitable material.

The essential advantage of this construction of connector according to the invention can be comprehended from the following.

Since through the interaction of the annular groove and the packing ring a kind of snap connection is formed, the junction piece is easily insertable into the socket of the casing. Furthermore fewer movable parts are present so that a rapid assembly and dissassembly is ensured, wherein the junction piece does not need to be screwed up. The yoke can preferably be fastened to the junction piece with a triangular screw or the like. In the use of this junction piece according to the invention the cable, which contains the electrical leads, thus undergoes no transverse crushing and no pressing. If the junction piece is used for example for extension lights in mining operations, the high safety considerations required there are fulfilled and the junction piece can also be used for any cable thickness.

BRIEF DESCRIPTION OF THE DRAWINGS

The invention is described below in greater detail with reference to one embodiment illustrated in the accompanying drawing.

On the drawing.

DETAILED DESCRIPTION OF THE PREFERRED EMBODIMENT

Figure 1:
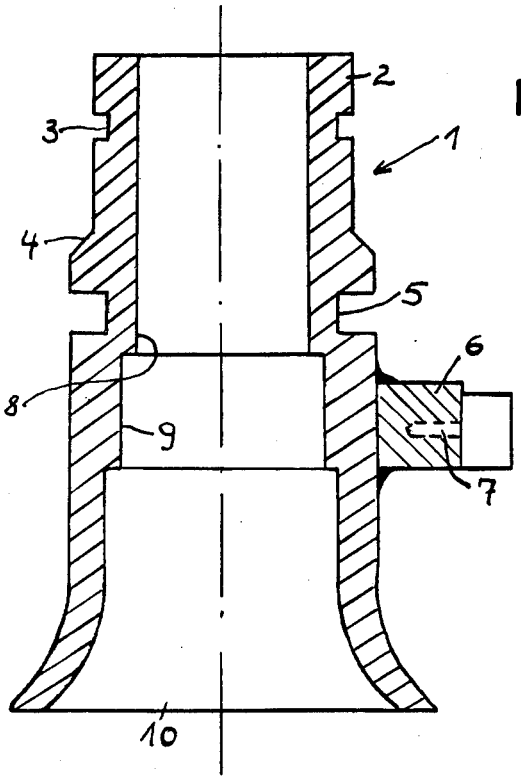
FIG. 1 shows a longitudinal section through the junction piece according to the invention.

As is shown in FIG. 1, the junction piece has a substantially cylindrical form and has a flared opening at its lead-in end for the cable. This opening 10 is provided in order the more easily to introduce the cable to be connected with an appliance to be supplied with current. The further interior of the junction piece 1 is substantially cylindrical. In the embodiment shown it is reduced from the inner diameter 9 to the inner diameter 8. Obviously this region of the interior can also have a uniform diameter.

In the upper region of the junction piece 1 (FIG. 1) the sleeve 2 has an annular groove 3 for the reception of a packing ring (not shown) which can be brought into engagement with an inner groove provided in a socket for the appliance to be supplied and forms with this socket a kind of locking connection.

In addition there is provided on the outer circumference of the junction piece 1 a bevelled shoulder 4 widening towards the lead-in end for the cable. This shoulder is intended to interact in the full attachment with a correspondingly shaped annular groove in the inside of the socket (not shown).

Furthermore the junction piece has a recess 5 on its outer surface, which has a substantially rectangular cross-section, the function of which will be explained below.

As is also shown in FIG. 1 the junction piece 1 has a lateral attachment 6 with a circular cavity in the base of which is inserted a threaded bore 7. In the embodiment illustrated the attachment 6 is welded to the connector 1. However this attachment can be formed integrally with the junction piece.

Figure 2:
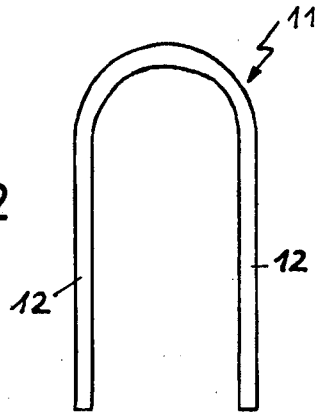
FIG. 2 shows a rear view of the yoke for the junction piece according to FIG. 1.
Figure 3:
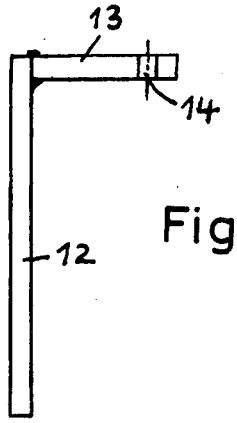
FIG. 3 is a side view of the yoke shown in FIG. 2

In FIGS. 2 and 3 a yoke 11 is provided which belongs to the junction piece according to FIG. 1. This yoke 11 is provided such that its shanks 12 fit into the recess 5 and additionally into corresponding openings in the socket, so that a rotation-resistant connection is created. For enhancing this rotation-resistant connection the yoke 11 has at its upper part a projection 13, which is welded there or can be formed integrally with the yoke 11. This projection 13 has a hole 14 so that a connecting screw can be screwed into the bore 7 when the yoke 11 cooperates with the connector and the socket of the appliance to be supplied with current.

The connector has along its interior at least one groove (not shown) so that the introduced cable, in which likewise a corresponding groove can be formed, can be cast in, in rotation-resistant manner with the junction piece, wherein the casting means adheres to the sleeve of the cable and is embedded in this groove.

The junction piece shown can be provided in a simple manner with a cable, whose electric leads can be connected with the appliance to be supplied with current, without requiring a skilled worker for this purpose.

Figure 4:
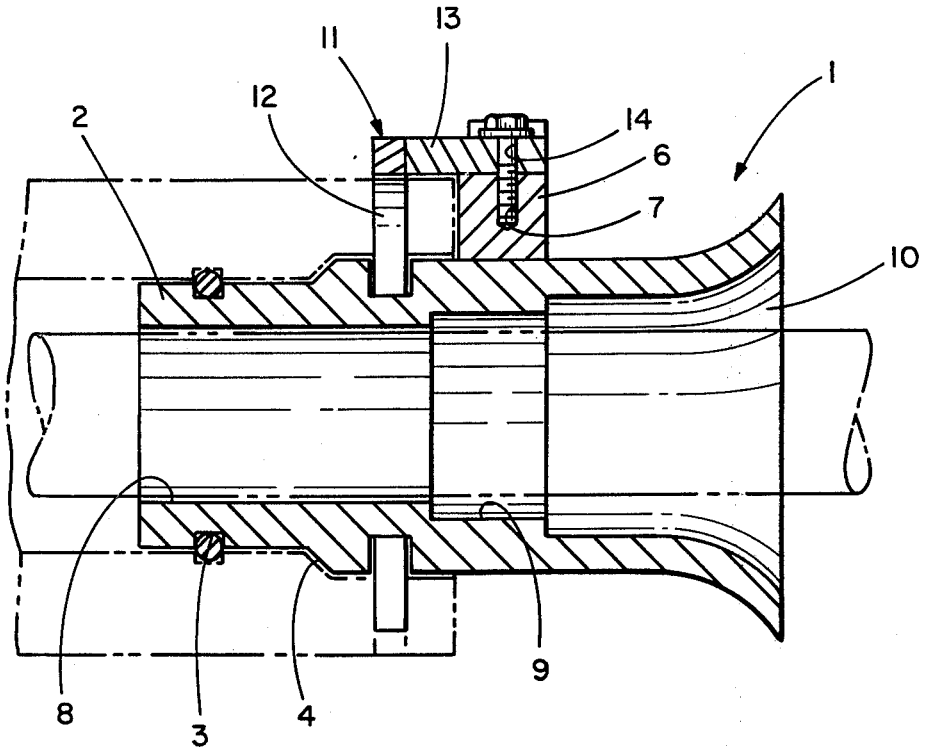
FIG. 4 shows the invention of FIGS. 1 and 2 as it would be attached to the socket of an appliance for receiving a cable containing electrical leads therethrough.

This is illustrated in FIG. 4 of the drawing in which the assembled junction piece comprising the elements shown in FIGS. 1, 2 and 3 is attached to the socket of the appliance (shown in phantom lines) and in which a cable for electrical leads (also shown in phantom lines) is positioned through the flared opening 10 and the interior of the junction piece 1. At the same time the described junction piece ensures a rapid assembly and disassembly and furthermore an extremely pressure-resistant and rotation-resistant connection with the appliance to be supplied with current, without having to use technically expensive means.

After introduction of the cable into the junction piece an attachment is joined by casting at its exit zone with a suitable synthetic material. This synthetic material softens the cable skin and gives a firm connection with it. Since the synthetic material at the same time fills the longitudinal groove or grooves of the junction piece a slippage-resistant and rotation-resistant connection of cable and junction piece is thus created.

I claim:

1. An improved unitary junction piece for a cable containing electrical leads for an appliance to be supplied with current comprising a funnel-shaped entry at one end of the junction piece for receiving the cable, the other end of the junction piece having an annular groove in an outer wall for receiving a packing ring therein, a bevelled shoulder formed on the outer wall of the junction piece adjacent said annular groove and adapted to engage the inner wall of a socket of the appliance when the junction piece is in position, a recess around the outer wall of the junction piece intermediate the bevelled shoulder and the funnel-shaped entry, and yoke means having shanks insertable into said recess for locking the yoke means to the junction piece.

2. An improved junction piece in accordance with claim 1 wherein at least one longitudinal groove is provided in the inner wall surface of the junction piece.

3. An improved junction piece in accordance with claim 1 wherein the yoke means has a projection with a bore extending at right angles to said shanks through which bore a screw can be inserted to fasten the yoke to the junction piece.

* * * * *